US005681428A

United States Patent [19]

Nakajima et al.

[11] Patent Number: 5,681,428

[45] Date of Patent: Oct. 28, 1997

[54] METHOD OF MANUFACTURING AN INORGANIC BOARD

[75] Inventors: Shiro Nakajima, Fukusumi; Masaki Kanai, Kuwana, both of Japan

[73] Assignee: Nichiha Corporation, Nagoya, Japan

[21] Appl. No.: 598,106

[22] Filed: Feb. 7, 1996

[30] Foreign Application Priority Data

Dec. 20, 1995 [JP] Japan ..... 7-349600

[51] Int. Cl.[6] ..... D21F 13/06

[52] U.S. Cl. ..... 162/117; 162/119; 162/120; 162/128; 162/132; 162/133; 162/145; 162/146; 162/152; 162/154; 162/181.6; 162/222; 162/223; 162/225

[58] Field of Search ..... 162/152, 154, 162/155, 120, 119, 221, 222, 223, 145, 296, 117, 109, 265, 266, 285, 284, 283, 128, 132, 133, 181.6, 146, 225

[56] References Cited

U.S. PATENT DOCUMENTS 1,500,209 7/1924 Shaw ..... 162/296

2,171,155 8/1939 Wright, Jr. ..... 162/117

2,738,713 3/1956 Buczkowski et al. ..... 162/117

2,818,824 1/1958 Read et al. ..... 162/117

*Primary Examiner*—Peter Chin

*Attorney, Agent, or Firm*—Donald S. Dowden

[57] ABSTRACT

An inorganic board consisting of a cured base mat and a cured surface mat is manufactured by forming a surface mat by the dry method on a base mat formed by a paper making method, embossing the composite mat, and curing the embossed composite mat. Ridges each having an enlarged top are formed on the surface of the base mat when a plural number of single mats formed by the paper making method are rolled and laminated around a making roll having a surface on which a plural number of ring grooves are formed. The ridges of the base mat engage the surface mat since each ridge has an enlarged top to improve the inter-laminate strength between a cured base mat and a cured surface mat of the resulting inorganic board.

4 Claims, 8 Drawing Sheets

METHOD OF MANUFACTURING AN INORGANIC BOARD

THE FIELD OF THE INVENTION

The present invention relates to a method of manufacturing an inorganic board. More particularly, the present invention relates to a method of manufacturing an embossed inorganic board having a design with deep dents and high interlaminate strength. Said inorganic board is used as a building material for such as siding.

DESCRIPTION OF THE PRIOR ART

An embossed inorganic board has been provided as a building material for such as siding. Hitherto, said inorganic board has been manufactured by the paper making method or the dry method including the semi-dry method. Said paper making method comprises preparing slurry of a mixture substantially consisting of cement material and reinforcing fiber such as wood fiber, forming a mat on a porous support, dehydrating the resulting mat on said porous support by vacuum sucking or cylinder pressing, embossing said mat by an embossing roller or an embossing plate and incubating said embossed mat to cure said cement material in said mat.

On the other hand, said dry method comprises preparing a powdery mixture of cement material and reinforcing fiber such as wood fiber, and said powdery mixture also containing water in an amount less than 40% by weight, spreading said powdery mixture on a mold panel to form mat of said powdery mixture, pressing an embossing plate onto the resulting mat, incubating said embossed mat by pressing between said mold panel and said embossing plate to cure said cement material in said inorganic layer and removing said mold panel and said embossing plate to cure said cement material in said inorganic layer and removeing said mold panel and said embossing plate from the resulting inorganfc board.

When said wet method is employed to manufacture inorganic board, said inorganic board can be manufactured by the continuous process in the case where the embossing roller is employed. Nevertheless, since said mat formed by the paper making method has high density and high structural strength due to vacuum sucking or cylinder pressing in the dehydration process, it is difficult to emboss a design with deep dents into said mat. If said mat is embossed so as to form deep dents on the surface of said mat, the compression ratio of said mat will become large and as a result, cracks may be formed in the protrusions of the surface of said mat.

When said dry method is employed to manufacture inorganic board, it is easy to emboss a design with deep dents into said mat formed by the dry method since said mat formed on the mold plate by the dry method has low density. Nevertheless, it is impossible to manufacture said inorganic board by the continuous process since each mat is incubated between the mold panel and the embossing plate. Further, since one mold panel, one embossing plate and one pressing means should be prepared for one mat formed by the dry method, the manufacturing cost becomes high in said semi-dry method.

To resolve these problems, a method comprising forming a base mat by a paper making method, forming a surface mat on said base mat by the dry method, embossing said surface mat of the resulting composite mat and incubating said composite mat to manufacture an inorganic board has been provided (TOKKAI SHO-61-171313, TOKKAI HEI-5-200713, TOKKAI HEI-5-200714). By employing the above described method, an embossed inorganic board having a design with deep dents can be manufactured by the continuous process. Nevertheless, said method has a serious problem that the delamination strength between the cured base mat formed by the paper making method and the cured surface mat formed by the dry method is very low so that the freezing-melting resistance of the resulting inorganic board is very poor since moisture is apt to enter the boundary between the cured base mat and the cured surface mat. TOKKAI HEI 5-200713 discloses a means to improve the freezing-melting resistance of inorganic board by mixing an acrylic synthetic resin emulsion with the surface mat formed by the dry method. Nevertheless, when said surface mat is embossed, said acrylic synthetic resin in said surface mat sticks to the surface of the embossing roller or the embossing plate, and as a result, it becomes difficult to release said inorganic board smoothly from said embossing roller or said embossing plate.

SUMMARY OF THE INVENTION

Accordingly, an object of the present invention is to provide an embossed inorganic board having a design with deep dents.

Another object of the present invention is to provide a method of manufacturing an embossed inorganic board having a design with deep dents wherein said embossed inorganic board is continuously manufactured.

A further object of the present invention is to provide an embossed inorganic board consisting of a cured surface mat and a cured base mat wherein said inorganic board has a high delamination strength between said cured surface mat and said cured base mat.

Said objects can be attained by providing a method of manufacturing an inorganic board comprising forming a single mat by the paper making method using slurry of a mixture substantially consisting of cement material and reinforcing fiber, rolling and laminating the plural number of said single mats around a making roll to form a base mat, said making roll has a surface on which the plural number of ring grooves are formed, unrolling said based mat rolled and laminated around said making roll by cutting said base mat in a fixed length and stripping said cut base mat from said making roll, pressing the surface of said base mat to enlarge the top of ridges formed on the surface of said base mat by ring grooves of said making roll, spreading a powdery mixture substantially consisting of cement material and reinforcing fiber to form a surface mat on said base mat, embossing the resulting composite mat, and incubating said embossed composite mat to cure the cement material in said composite mat.

In said method, said ridges of said base mat having enlarged tops engage said surface mat to improve the interlaminate strength.

DETAILED DESCRIPTION OF THE INVENTION

Figure 1:
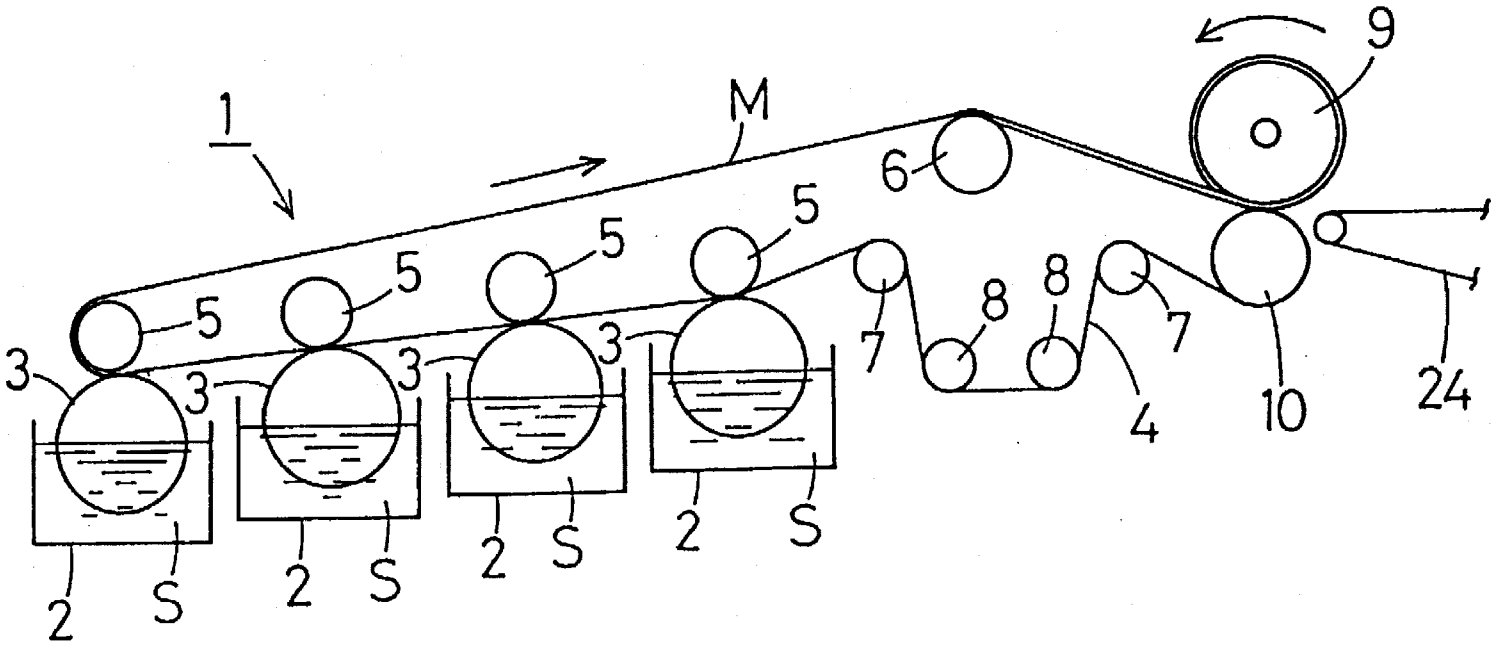
FIG. 1. An illustration of the Hachek paper making machine.

The present invention relates to a method of manufacturing an inorganic board comprising forming a single mat by the paper making method using slurry of a mixture substantially consisting of cement material and reinforcing fiber, rolling and laminating the plural number of said single mats round a making roll to form a base mat, said making roll has a surface on which the plural number of ring grooves are formed, unrolling said based mat rolled and laminated around said making roll by cutting said base mat in a fixed length and stripping said cut base mat from said making roll, pressing the surface of said base mat to enlarge the top of ridges formed on the surface of said base mat by ring grooves of said making roll, spreading a powdery mixture substantially consisting of cement material and reinforcing fiber to form a surface mat on said base mat, embossing the resulting composite mat, and incubating said embossed composite mat to cure the cement material in said composite mat.

[Materials of the Inorganic Board]

The inorganic board of the present invention consists of a base mat formed by the paper making method and a surface mat formed by the dry method. The materials of said base mat and said surface mat include cement material and reinforcing fiber. Said cement material is such as Portland cement, blast furnace cement, fly ash cement, silica cement, alumina cement and the like. One or more kinds of said cement may be mixed.

Said reinforcing fiber is synthetic fiber such as pulp fiber, opened scrap paper, polyester fiber, polyamide fiber, acryl fiber, acetate fiber, polyethylene fiber, polypropylene fiber and the like; and an inorganic fiber such as glass fiber, carbon fiber, ceramic fiber and the like. One or more kinds of said reinforcing fiber may be mixed.

Said cement material and said reinforcing fiber are usually mixed 100:1~100:15 by weight.

Besides said cement material and said reinforcing fiber, if desirable, an aggregate such as silica sand, silica powder, silica fume, silas baloon, pearlite, mica, diatomaceous earth, dolomite, gypsum, wollastonite, fly ash, blast furnace slag, coal cinder, glass powder, silica clay, alumina, bentonite, calcium carbonate, magnesium carbonate may be used in the present invention. Further if desirable, a curing promoter such as calcium cloride, magnesium chloride, magnesium hydrochloride, aluminum sulfate, sodium alminate, water glass and the like; a water-proofing agent such as wax, praffin, silicon and the like may be used.

Also further, if desirable, crushed scrap of inorganic board substantially consisting of cement material and reinforcing fiber is mixed by 40% by weight of the solid content. Since said crushed scrap of said inorganic board contains pulp fiber of 2–3% by weight, said reinforcing material in the mixture can be saved when said crushed scrap of said inorganic board is mixed.

[Forming of the Base Mat by the Paper Making Method]

In the case where the base mat is formed by the paper making method, said mixture of the materials is dispersed in the water to prepare slurry. Commonly the solid content of said prepared slurry is in the range between 5 to 15% by weight. The base mat is formed by a common method such as the Hachek method, the long net method, and the like.

The Hachek paper making machine is shown in FIG. 1. In said Hachek paper making machine (1), the plural number of slurry tanks (2) in each of which a mesh cylinder (3) is arranged are installed. In each slurry tank (2) said slurry S is attached on said mesh cylinder (3) to be scooped out by said mesh cylinder (3) and said slurry S scooped on said mesh cylinder (3) is transferred on an endless filter cloth belt (4) hung on the plural number of supporting rolls (6,7) and stretched by a pair of take up rolls (8,8) which are arranged between said supporting rolls (7,7). Said endless filter cloth belt (4) rounds along said supporting rolls (6,7) and the water contained in said slurry transferred on said endless filter cloth belt (4) is squeezed out by the plural number of press rolls (5) each of which is pressed toward said mesh cylinder (3) in each slurry tank (2) and as a result a single mat M is formed on said endless filter cloth belt (4).

Said single mat M is rolled around a making roll (9) at the end of said endless filter cloth belt (4) and the fixed number of said single mats M are laminated around said making roll (9) wherein said making roll (9) is backed up by a back up roll (10) through said endless filter cloth belt (4).

Figure 2:
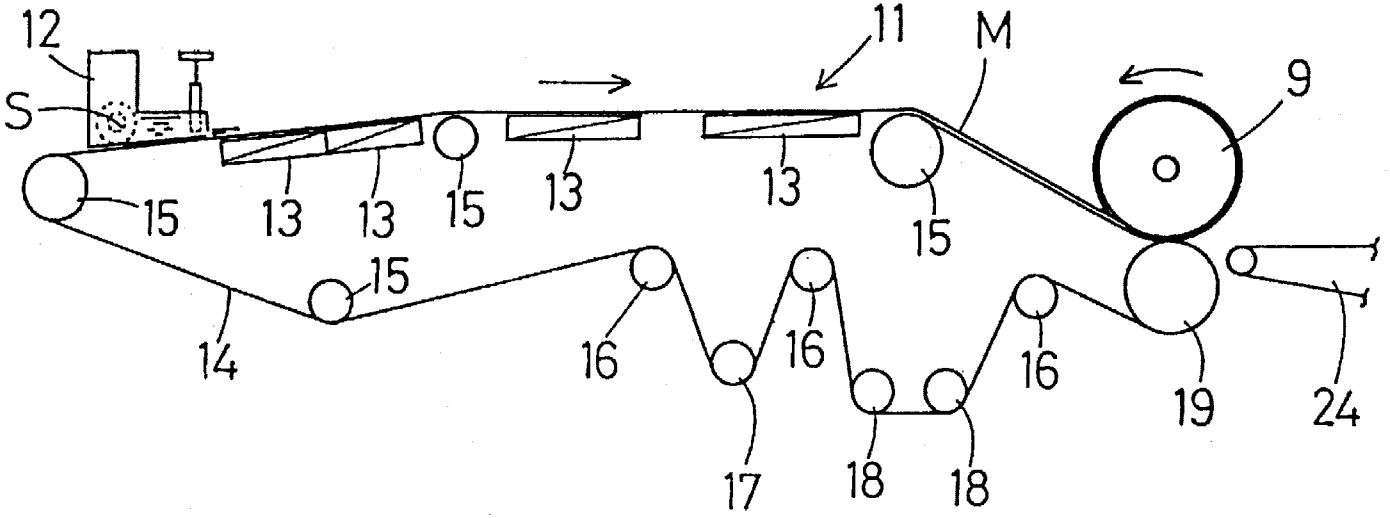
FIG. 2. An illustration of the long net paper making machine.

The long net paper making machine (11) is shown in FIG. 2. In said long net paper making machine (11), slurry S flows out onto an endless filter cloth belt (14) from flow box (12) and suction boxes (13) are contacted on the underside of said endless filter cloth belt (14). Slurry S flowing out on said endless filter cloth belt (14) is dehydrated said suction boxes (13) to form a single mat M. Said endless filter cloth belt (14) is hung on the plural number of supporting rolls (15,16) and streched by a pair of take up rolls (17,18) which are arranged between said supporting rolls (15,16). Said single mat M is rolled round a making roll (9) and the fixed number of said single mat M are laminated round said making roll (9) where said making roll (9) is backed up by a back up roll (19) through said endless filter cloth belt (14).

[Laminating the Single Mat Round the Making Roll]

Figure 3:
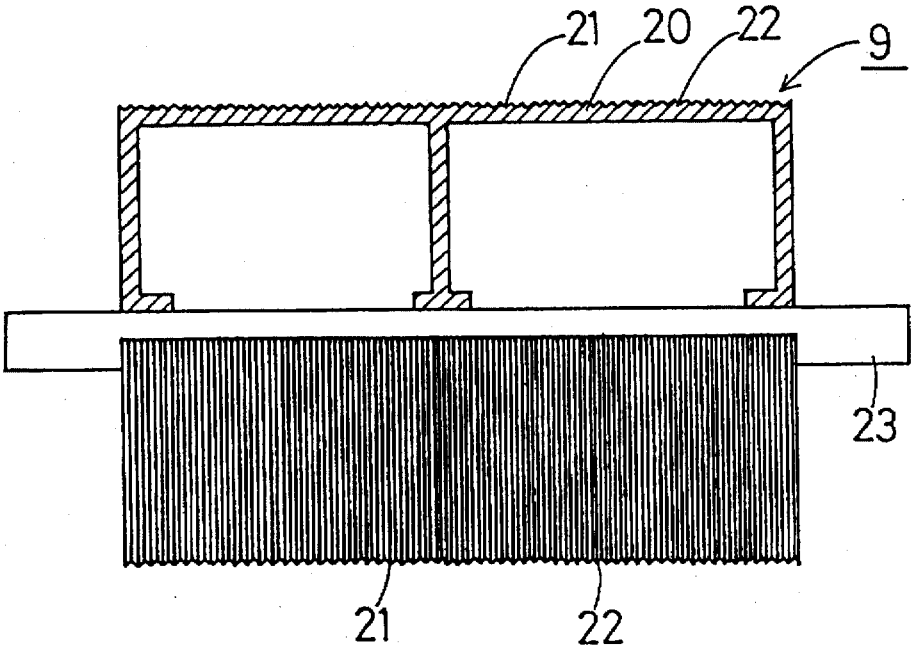
FIG. 3. A front view of the making roll omitted upper part of the making roll.
Figure 4:
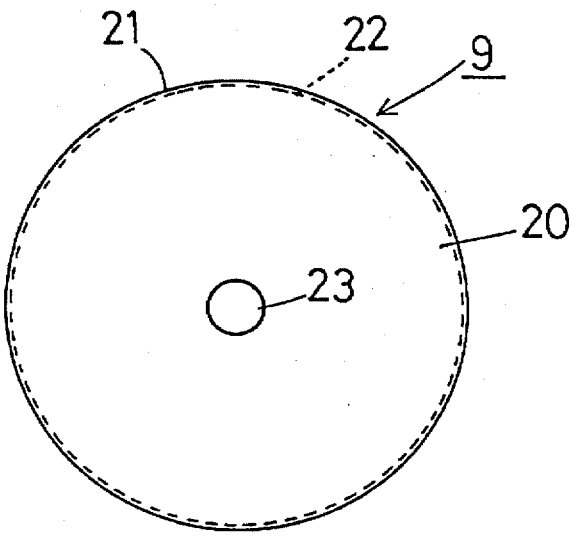
FIG. 4. A side view of the making roll.

In the above described methods, the Hachek method and the long net method, said single mat M is rolled and laminated around said making roll (9) as above described. Said making roll (9) consists of a cylindrical body (20) (FIGS. 3–5) and a shaft (23) by which said cylindrical body (20) is supported on bearings and the plural number of ring grooves (22) are formed on the surface (21) of said cylindrical body (20).

Figure 5:
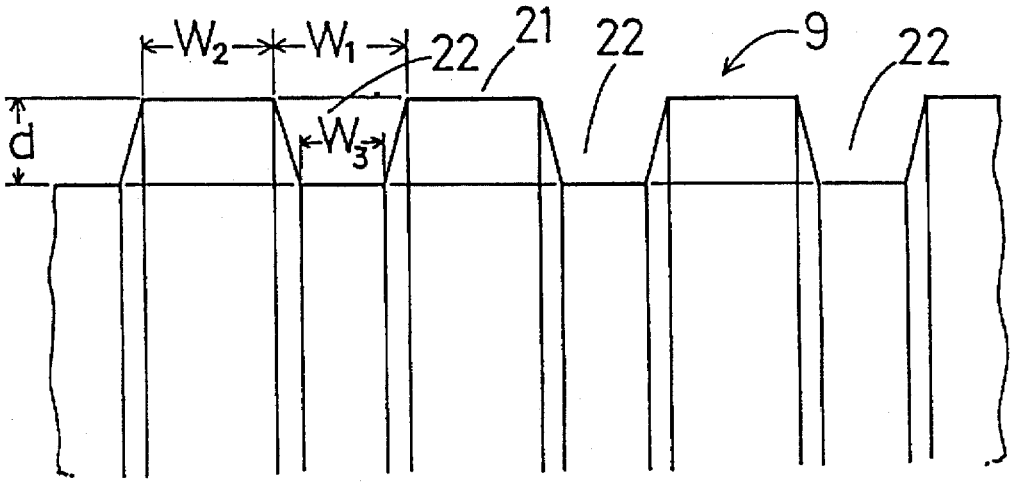
FIG. 5. A magnified partial plan view of the surface of the making roll.
Figure 6:
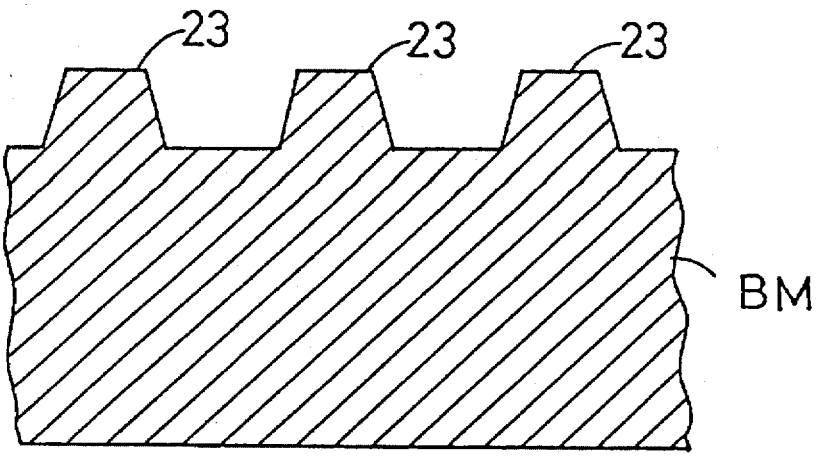
FIG. 6. A magnified partial plan view of the base mat.

A desirable shape of said ring grooves (22) is shown in FIG. 5 and the width $W_1$ of the upper end of said ring groove (22) is set in the range between 3 to 8 mm and the mutual distance $W_2$ of said ring grooves (22) is set to be equal to or larger than $W_1$. In the case where $W_2$ is smaller than $W_1$ in said making roll (9), the adherence of said single mat M to the surface of said making roll (9) may not be favorable and it is feared to peel off said single mat M from the surface of said making roll (9). Commonly, $W_2$ is set in the range between 5 to 10 mm. Further $W_1$, the width of the upper end of said ring grooves (22), is set to be equal to or slightly larger than the width of the lower end of said ring grooves (22) so that the shape of the cross section of said ring grooves (22) is a regular square, a rectangle, or a reverse trapezoid and the depth d of said ring grooves (22) is usually set in the range between 1 to 5 mm.

When said ring grooves (22) of said making roll (9) have an above described shape and size, said single mat M is smoothly rolled and laminated around said making roll (9) and filled into each ring groove (22). To make certain that said grooves (22) have the above described shape and size, it is desirable to wind a rigid synthetic resin sheet or rigid rubber sheet having said ring grooves (22) on their outer surface around said making roll (9).

[Cutting and Stripping the Base Mat BM]

Said base mat BM rolled and laminated round said making roll (9) commonly has a thickness about 13 to 20 mm and the plural number of ridges (23) are formed on the surface of said base mat BM corresponding to the ring grooves (22) of said making roll (9). Said base mat BM is cut in a fixed length and stripped from said making roll (9) and said spread base mat BM is transferred on a spreading conveyer (24).

[Press of the Ridges of the Base Mat BM]

Figure 7:
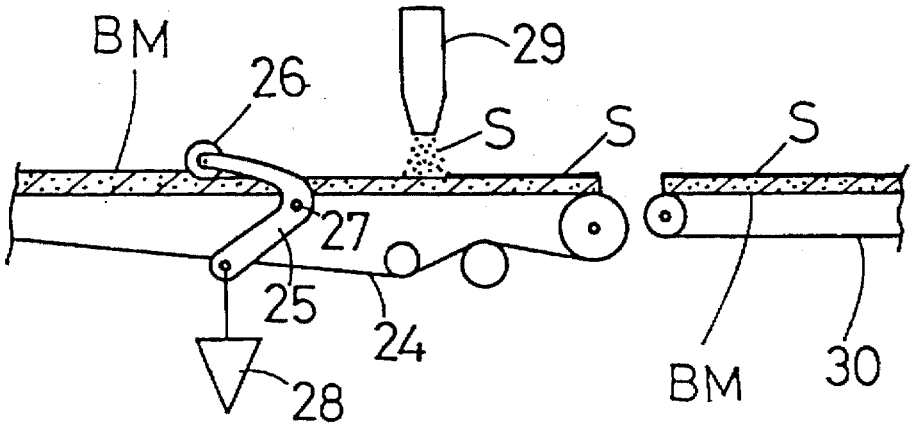
FIG. 7. An illustration of press process and slurry coating process.
Figure 8:
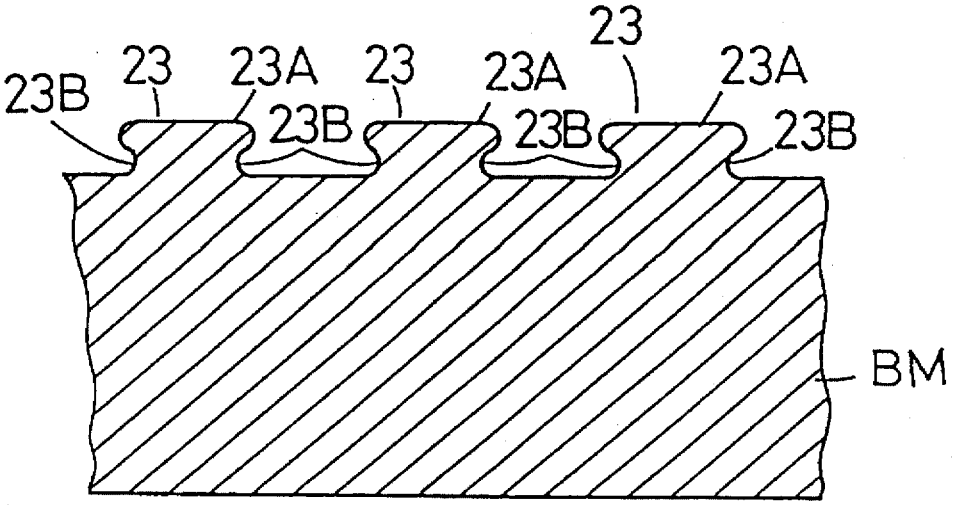
FIG. 8. A magnified partial plan view of a base mat BM after press process.

The surface of said base mat BM transferred on said spreading conveyer (24) is pressed by a press roll (26) supported at the upper end of a V-shaped lever (25) as shown in FIG. 7. Said V-shaped lever (25) is rotatably supported by an axis (27) at the middle part thereof and a weight (28) is hung from the lower end of said V-shaped lever (25) to press and press roll (26) to said surface of said base mat BM. By press of said press roll (26), the tops (23A) of said ridges (23) on the surface of said base mat BM are compressed and enlarged as shown in FIG. 8 and side ditches (23B) are formed on both sides of said ridges (23). In the present invention, a press panel is also used instead of said press roll (26).

[Coating Slurry]

Slurry S of the mixture of the materials of the inorganic board is coated on the surface of said base mat BM by wing a slurry nozzle (29) shown in FIG. 7. If desirable a synthetic resin emulsion and/or a rubber latex may be mixed in said slurry S. Usually, said synthetic resin emulsion and/or a rubber latex is added to said slurry S in an amount in the range between 3 to 15% by weight as solid.

Said synthetic resin emulsion used in the present invention is such as acrylic resin, polystyrene resin, vinyl acetate resin, polyethylene resin, polypropylene resin, polyvinyl chloride resin, vinylidene chloride copolymer, ethylene-propylene copolymer, ethylene-vinyl acetate copolymer, and said rubber latex used in the present invention is such as chloroprene rubber, isoprene rubber, butadiene rubber, butyl rubber, styrene-butadiene rubber , acrylonitrile-styrene-butadiene rubber, acrylonitrile-butadiene rubber.

Commonly coating amount of said slurry S is 3000 to 4000 g for 1 $m^2$ of said base mat BM, and the water content of the surface of said base mat BM on which said ridges (23) are formed, especially the water content of the side ditches (23B) of said ridges (23), in which said synthetic resin emulsion and/or said rubber latex is (are) apt to stay, becomes higher so that the stickness of the surface of said base mat BM, especially stickness of the side ditches (23B) of said ridge (23) of the surface of said base mat BM, is increased. Said stickness may be much more increased by adding said synthetic resin emulsion and/or said rubber latex in said slurry S.

[Forming Process of the Surface Mat SM]

Figure 9:
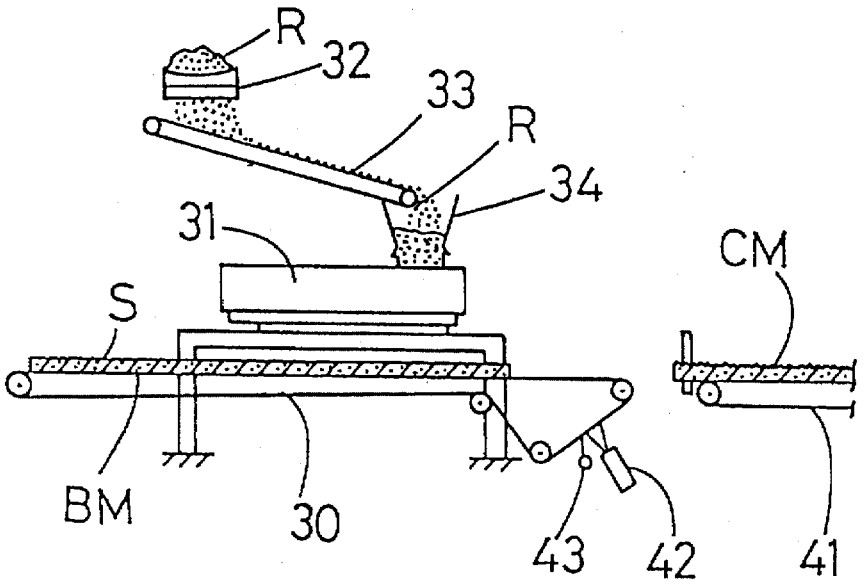
FIG. 9. An illustration of a surface mat forming process.
Figure 10:
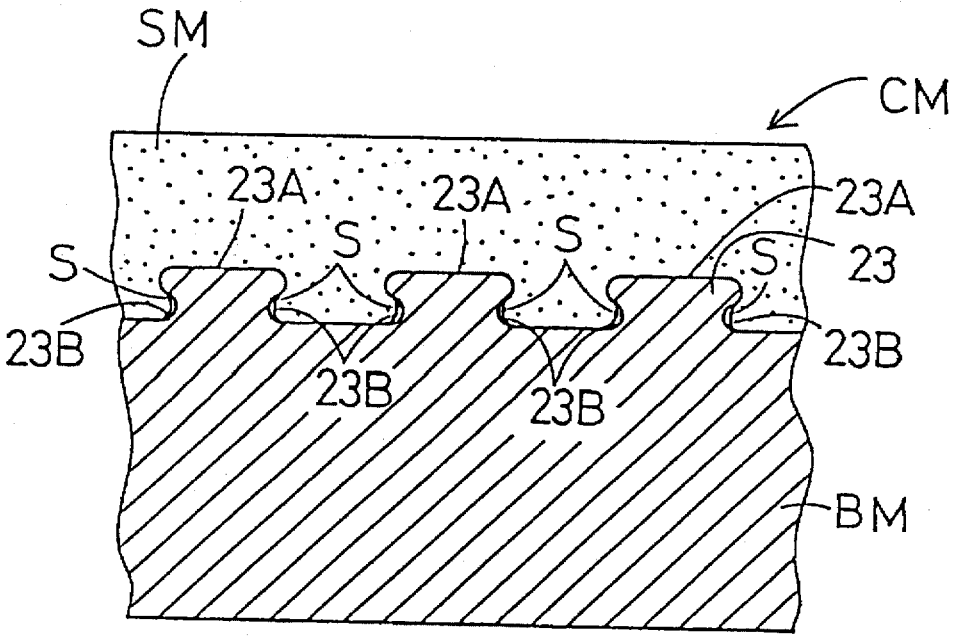
FIG. 10. A magnified partial plan view after slurry coating process.
Figure 11:
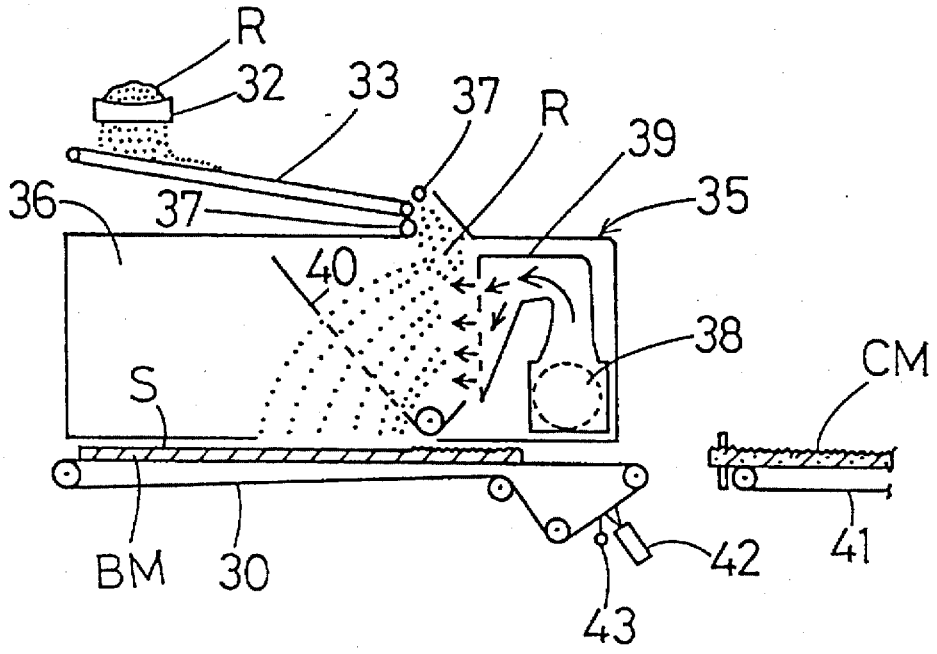
FIG. 11. An illustration of another surface mat forming process.
Figure 12:
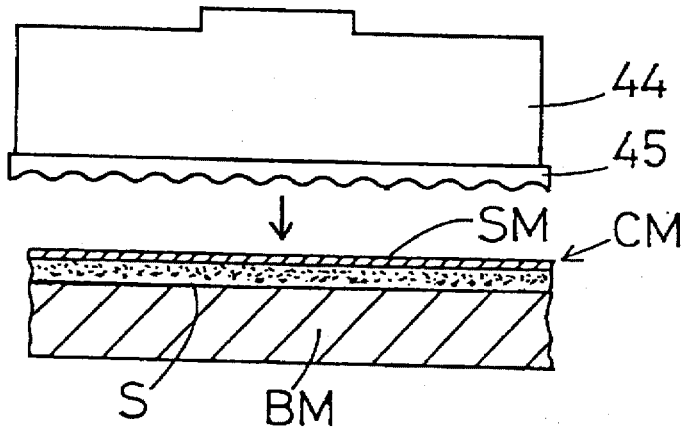
FIG. 12. An illustration of embossing and incubation process.
Figure 13:
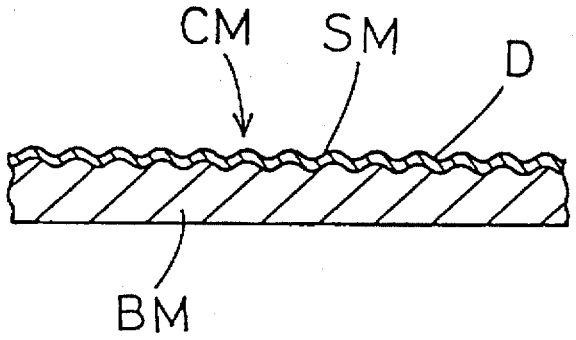
FIG. 13. A partial sectional view of the composite mat after embossing and incubation process.

Said base mat BM having the surface the stickness of which is increased by coating said slurry S is transferred to a transporting conveyer (30) and a mixture R (FIGS. 9 and 11) materials having the same composition as the mixture of materials of said slurry S is spread on the surface of said base mat BM to form a surface mat SM (FIGS. 10, 12 and 13). The spreading amount of said mixture is usually in the range between 1 to 2 kg per 1 $m^2$ of said base mat BM. A sieve device (31) such as a plane type sieve device or a vibration type sieve device shown in FIG. 9 is used to spread said mixture R and said mixture R is supplied in a hopper (34) of said sieve device (31) from a materials tank (32) by a supplying conveyer (33) and spread by said sieve device (31) on said base mat BM.

As above mentioned, a composite mat CM consisting of a base mat BM and a surface mat SM which is formed on said base met BM is manufactured as shown in FIG. 10. In said composite mat CM, the under side of said surface mat SM is engaged by side ditches (23B) formed on the sides of said ridges (23) on the surface of said base mat BM so that said surface mat SM attaches to said base mat the surplice of which has an increased stickiness by coating said slurry S.

The forming machine (35) as shown in FIG. 11 may be used for forming said surface mat SM. A mixture R of materials of said surface mat SM is fed into a chamber (36) by a feeding roller (37). Said mixture R is supplied to said feeding roller (37) from a mixture tank (32) through a supplying conveyer (33). In said chamber (36), air is blown against said fed mixture R from a fan (38) through a duct (39) and a filter (40) and said surface mat SM is formed on said base mat BM and transferred on the transporting conveyer (30).

The resulting composite mat (CM) is transferred on a trimming conveyer (41) and trimmed. After said composite mat (CM) is transferred, said transporting conveyer (30) is washed by spraying with water from a washing nozzle (42) and squeezed by a squeezing blade (43).

[Embossing and Incubating]

Figure 14:
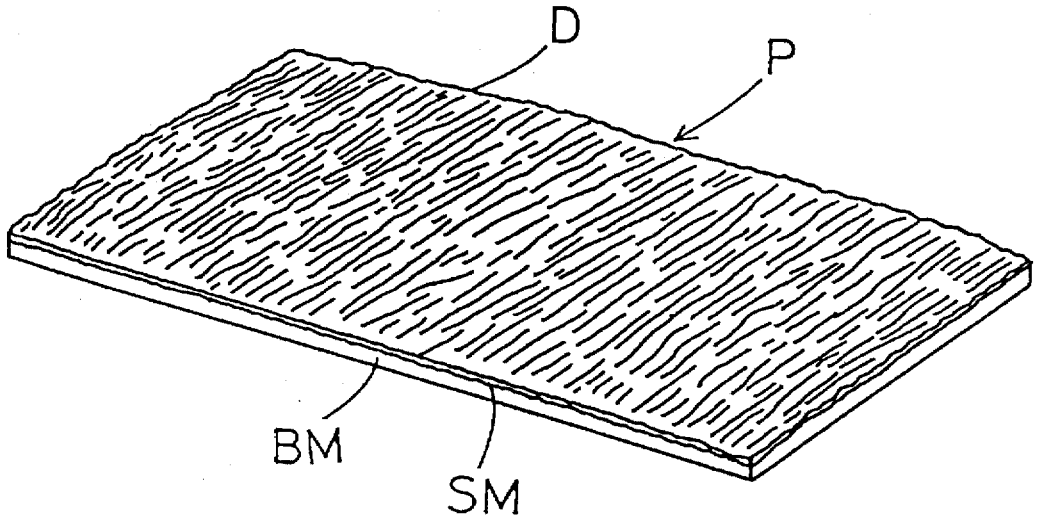
FIG. 14. A perspective view of an inorganic board.

Said composite mat (CM) is then embossed by an embossing plate (45) supported by a press machine (44) as shown in FIG. 12 or by a roll press machine to form an embossing design D on the surface of said composite mat CM as shown in FIG. 12. Said slurry S coated on said base mat BM of said composite mat CM permeates said surface mat SM by said pressing by said embossing plate (44) to supply water to the inorganic curable material in said surface mat SM. The resulting embossed composite mat CM shown in said FIG. 13 is then incubated by heating to cure the inorganic materials in said base mat BM and surface mat SM of said composite mat CM to manufacture an embossed inorganic board P as shown in FIG. 14. Usually a temperature in the range between 70° to 90° C., the humidity in the range between 90 to 100% RH and an incubation time in the range between 10 to 20 hours are applied in said incubation process.

In the present invention, since a surface mat SM formed by the dry method is formed on a base mat BM formed by the papering method, an inorganic board having a deep embossing design on the surface thereof can be manufactured with a high manufacture effect. Further since slurry of the mixture of the materials of the inorganic board is coated on said base mat BM having a surface on which the plural number of ridges are formed wherein side ditches are formed on both sides of said ridges, high bonding strength is obtained between said base mat BM and said surface mat SM depending on the engaging effect of said ridges and the sticking effect of said slurry.

[Example]

A making roll (9) round which a rigid rubber sheet is wound was used. The plural number of the ring grooves (22) are formed on the outer surface of said rigid rubber sheet and the upper width $W_1$ of said ring grooves (22) is 3 mm, the mutual distance $W_2$ of said ring grooves (22) is 5 mm, and the depth d of said ring groove (22) is 3 mm.

A base mat BM was formed by rolling and laminating said single mat M round said making roll (9) wherein said single mat M was formed by the paper making method and the plural number of ridges (23) were formed on the surface of said base mat BM. The height of said ridges (23) was 1~5 mm and the compositions of said base mat BM of each EXAMPLE is shown in Table 1.

On the surface of said base mat BM, slurry S of a mixture having the same composition as said base mat BM and a solid content 11 g/dl was coated in the amount of about 3400 g/m$^2$ and then the mixture of the materials of the inorganic board was spread on said surface of said base mat BM on which said slurry S was coated to form a surface mat SM. The composition of said mixture of each EXAMPLE is also shown in Table 1.

The surface of the resulting composite mat CM was pressed by an embossing plate (45) to form an embossing design D on the surface of said composite mat CM. The resulting embossed composite mat CM was then incubated by a condition described in Table 1 with heating to cure said cement material in said composite mat CM to manufacture inorganic boad sample No. 1 to 8.

The result of estimation of properties of said inorganic samples are listed in Table 1.

[Table 1]

Referring to Table 1, in samples No. 1 to 5 (EXAMPLE 1 to 5) relating to the present invention. Five embossing designs without crack were respectively formed on the surfaces of samples in the case of embossing design having a depth less than 4.2 mm and each sample shows high bending strength between base mat BM and surface mat SM (vertical tensile strength), while in sample No. 6 (Comparison 1) consisting of only a mat formed by the paper making method, cracks already take place on the surface of the sample in the case where the embossing design having a depth 2 mm and in sample No. 7 (Comparison 2) wherein base mat BM was formed by using the making roll having no ring groove on the surface, it is feared to have cracks on the surface in the case of the embossing design having a depth more than 3 mm and further sample No. 7 had small vertical tensile strength. Further in sample No. 8 (Comparison 3) wherein the water is coated on the surface of base mat BM instead of the slurry, the mixture of the materials R in surface mat SM of sample No. 8 stuck to the embossing plate and further said surface mat SM was cured not uniformly in incubation process resulting in low bending strength and low vertical tensile strength.

TABLE 1

| | EXAMPLE 1 SAMPLE 1 | EXAMPLE 2 SAMPLE 2 | EXAMPLE 3 SAMPLE 3 | EXAMPLE 4 SAMPLE 4 | EXAMPLE 5 SAMPLE 5 | COMPARISON 1 SAMPLE 6 | COMPARISON 2 SAMPLE 7*[4] | COMPARISON 3 SAMPLE 8 |
|---|---|---|---|---|---|---|---|---|
| Formation of Base mat BM % | | | | | | | | |
| Portland cement | 35.0 | 35.0 | 35.0 | 35.0 | 35.0 | 35.0 | 35.0 | 35.0 |
| Blast furnace slag | 25.0 | 25.0 | 25.0 | 25.0 | 25.0 | 25.0 | 25.0 | 25.0 |
| Pearlite | 12.0 | 12.0 | 12.0 | 12.0 | 12.0 | 12.0 | 12.0 | 12.0 |
| Fly ash | 10.0 | 10.0 | 10.0 | 10.0 | 10.0 | 10.0 | 10.0 | 10.0 |
| Crushed scrap of cement board | 10.0 | 10.0 | 10.0 | 10.0 | 10.0 | 10.0 | 10.0 | 10.0 |
| Silica micro powder | 2.0 | 2.0 | 2.0 | 2.0 | 2.0 | 2.0 | 2.0 | 2.0 |
| Pulp fiber | 6.0 | 6.0 | 6.0 | 6.0 | 6.0 | 6.0 | 6.0 | 6.0 |
| Slurry | | | | | | | | |
| Coating amount of the slurry | 3400 | 3400 | 3400 | 3400 | 3400 | Traditional method | 3400 | Water scattering |
| Mixing amount of the synthetic emulsion | — | — | — | 5.0 | 10.0 | | — | |
| Formation of Surface mat SM % | | | | | | | | |
| Portland cement | 23.9 | 23.9 | 23.9 | 23.9 | 23.9 | | 23.9 | 23.9 |
| Blast furnace slag | 23.1 | 23.1 | 23.1 | 23.1 | 23.1 | | 23.1 | 23.1 |
| Pearlite | 9.2 | 9.2 | 9.2 | 9.2 | 9.2 | | 9.2 | 9.2 |
| Fly ash | 10.0 | 10.0 | 10.0 | 10.0 | 10.0 | | 10.0 | 10.0 |
| Crushed scrap of cement board | 27.0 | 27.0 | 27.0 | 27.0 | 27.0 | | 27.0 | 27.0 |
| Magnesium hydrochloride | 2.8 | 2.8 | 2.8 | 2.8 | 2.8 | | 2.8 | 2.8 |
| Pulp fiber | 4.0 | 4.0 | 4.0 | 4.0 | 4.0 | | 4.0 | 4.0 |
| Scattering condition | | | | | | | | |
| Scattering amount kg/m$^2$ | 1.6 | 1.73 | 2.23 | 1.6 | 1.6 | | 1.6 | 1.6 |
| Water content of the mixture scattered % | 3.0 | 10.0 | 30.0 | 3.0 | 3.0 | | 3.0 | 3.0 |
| Press condition of the embossing | 4.1 | 4.1 | 4.1 | 4.1 | 4.1 | 4.1 | 4.1 | 4.1 |

TABLE 1-continued

| | EX-AMPLE 1 SAMPLE 1 | EX-AMPLE 2 SAMPLE 2 | EX-AMPLE 3 SAMPLE 3 | EX-AMPLE 4 SAMPLE 4 | EX-AMPLE 5 SAMPLE 5 | COMPAR-ISON 1 SAMPLE 6 | COMPAR-ISON 2 SAMPLE 7*4 | COMPAR-ISON 3 SAMPLE 8 |
|---|---|---|---|---|---|---|---|---|
| plate MPa | | | | | | | | |
| Heating condition in incubation °C. + hr | 80 + 15 | 80 + 15 | 80 + 15 | 80 + 15 | 80 + 15 | 80 + 15 | 80 + 15 | 80 + 15 |
| Bending strength MPa*1 | 14.3 | 14.0 | 14.1 | 14.8 | 15.4 | 15.1 | 12.8 | 12.4 |
| Vertical tensile strength MPa | 0.95 | 0.95 | 0.94 | 0.95 | 1.01 | 0.86 | 0.61 | 0.56 |
| Depth of emboss mm | 3.8–4.2 | 3.5–4.0 | 3.5–4.0 | 3.8–4.2 | 3.8–4.2 | 2.0–2.5 | 3.0–3.5 | 3.5–4.0 |
| Water absorption test %*2 | 0.24 | 0.25 | 0.23 | 0.21 | 0.20 | 0.24 | 0.25 | 0.25 |
| Freezing-thaw test thickness swelling ratio %*3 | 3.0 | 2.8 | 2.8 | 2.7 | 2.5 | 4.2 | 5.6 | 7.5 |
| General estimation | ○ | ○ | ○ | ◎ | ○ | X Crack | Δ insufficient depth | X Sticking to the embossing plate |

*1: in conforming to JIS A-1409
*2: in conforming to JIS A-5422 15 day-immersion
*3: in conforming to JIS A-1435 200 cycles swelling ratio
*4: Base mat BM was formed by a making roll having no ring grooves on the surface thereof

We claim:

1. A method of manufacturing an inorganic board comprising the steps of:

forming a single mat by a paper making method from a slurry substantially consisting of a cement material and reinforcing fiber;

rolling and laminating a plural number of said single mats around a making roll to form a base mat, said making roll having a surface on which a plural number of ring grooves are formed;

unrolling said base mat rolled and laminated around said making roll by cutting said base mat in a fixed length and stripping said cut base mat from said making roll;

pressing the surface of said base mat to enlarge the top of ridges formed on the surface of said base mat by the ring grooves of said making roll;

spreading a powdery mixture substantially consisting of cement material and reinforcing fiber to form a surface mat on said base mat to form a composite mat;

embossing the composite mat; and incubating said embossed composite mat to cure the cement material in said composite mat.

2. A method of manufacturing an inorganic board in accordance with claim 1 wherein the upper end of each of the ring grooves of said making roll has a width in the range of 3 to 8 mm, the separation between said ring grooves is equal to or greater than the width of the upper end of each of the ring grooves of said making roll, and the width of the upper end of each of the ring grooves of said making roll is equal to or greater than the width of the lower end thereof.

3. A method of manufacturing an inorganic board in accordance with claim 1 further comprising the step of winding a rigid synthetic resin sheet or rigid rubber sheet around said making roll, the plural number of grooves being formed in said sheet.

4. A method of manufacturing an inorganic board in accordance with claim 2 further comprising the step of winding a rigid synthetic resin sheet or rigid rubber sheet around said making roll, the plural number of grooves being formed in said sheet.

* * * * *